US005810404A

United States Patent [19]

Horne et al.

[11] Patent Number: 5,810,404

[45] Date of Patent: Sep. 22, 1998

[54] PORTABLE DOOR LOCK

[76] Inventors: James E. Horne; Alexa H. Warachowski, both of 2570 Walnut Blvd. #28, Walnut Creek, Calif. 94596

[21] Appl. No.: 781,400

[22] Filed: Jan. 10, 1997

[51] Int. Cl.[6] ..... E05C 19/18

[52] U.S. Cl. ..... 292/288; 24/442

[58] Field of Search ..... 292/288, 292, 292/258, DIG. 16; 24/306, 442, 302

[56] References Cited

U.S. PATENT DOCUMENTS

| | | | |
|---|---|---|---|
| 2,536,941 | 1/1951 | Jones | 292/288 |
| 3,893,725 | 7/1975 | Coulter | 292/258 |
| 4,326,394 | 4/1982 | Stein | 70/14 |
| 4,330,146 | 5/1982 | Sessions, Jr. | 292/258 |
| 4,589,692 | 5/1986 | Boyd | 292/297 |
| 5,154,459 | 10/1992 | Cochran | 292/288 |
| 5,415,444 | 5/1995 | Hull et al. | 292/288 |
| 5,501,494 | 3/1996 | Willetts | 292/288 |
| 5,542,723 | 8/1996 | Scharf | 292/289 |

*Primary Examiner*—Flemming Saether
*Attorney, Agent, or Firm*—Dergosits & Noah LLP

[57] ABSTRACT

A portable door lock for use in holding closed a door that swings on hinges from an open position to a closed position wherein an edge of the door, opposite its hinged edge, is adjacent to a closure surface with a clearance gap therebetween. The portable door lock comprises a strap secured at one end to an anchor and to an opposite end to a locking member. The strap is positioned with the clearance gap such that the anchor abuts one side of the hinged door and one side of the closure surface. Simultaneously, the locking member is adjustably coupled to the strap at a particular point such that the locking member abuts an opposite side of the hinged door and an opposite side of the closure surface. In such a configuration, the door is held from motion with respect to the adjacent closure surface.

7 Claims, 5 Drawing Sheets

PORTABLE DOOR LOCK

FIELD OF THE INVENTION

This invention relates to the field of locks for hinged door. More particularly, this invention relates to portable locks for holding hinged doors in a closed position.

BACKGROUND OF THE INVENTION

A common problem faced by patrons of public restrooms is broken or missing locks on the restroom stall doors. This can be both frustrating and embarrassing. In such instances, patrons are usually forced to prop the stall door closed with their foot. For this reason a number of supplemental or auxiliary door locks have been devised for attachment to a hinged door to hold it in a closed position against unauthorized opening. Many of these door locks are not truly portable, because they require that modifications be made to the door jamb or frame. However, several require no such modifications, and may be carried from place to place by the user. Among these are the adjustable brace-type locks that are designed to be placed with one end against the floor and the other against the door, frequently at the doorknob. Unfortunately, these braces are generally too large to be carried in a pocket, briefcase or purse. Consequently, smaller and more easily-transported door-locking devices have also been developed. Most of these small, portable door-locking devices are adapted to operate in connection with the type of door having a jamb against which the door abuts when it is in its closed position. Furthermore, many of these locks are useful only with doors having locking bolts that are received in a bolt keeper recess or hole in the doorjamb.

For example, U.S. Pat. No. 3,596,961 to Lippman describes a portable door lock having a toothed latch bar with a hook for engaging the side of the keeper hole in a striker plate on the door frame. A resilient U-shaped band is provided that is slidable on the latch bar, and which has overlying cross tabs extending across the ends of the "U" to engage the teeth and thereby to block the door from opening.

U.S. Pat. No. 4,589,692 to Boyd describes a portable door lock that includes a thin sheet metal strap that fits between the door and the doorjamb. This strap has a fixed bolt on one end that is received in the keeper hole of the striker on the jamb when the door is open. The strap is placed with the bolt in the keeper hole, and the door is closed. A locking dog or brace that is pivotally mounted on the other end of the strap is then pivoted so as to overlap the strap and engage against the inner side of the door.

U.S. Pat. No. 5,280,977 to Piva describes a portable door lock that includes a generally flat base having a tooth thereon that is adapted to be received in the keeper hole of the striker on the jamb when the base is positioned next to the jamb and extending into the room to be locked. A locking arm connected to the base is movable against a bias inherent in the arm to a position that blocks the door from being opened. A peg may be inserted between the locking arm and the base to hold the arm in the blocking position against the bias.

U.S. Pat. No. 5,415,444 to Hull et al. describes a portable door lock that does not require cooperation with a keeper hole in a doorjamb. However, this door lock does require cooperation with a door knob. This lock includes a metal or plastic flexible strap that is attached at one end to a pair of interlocked tubular bars. The tubular bars are positioned outside the door at the base thereof with the strap passing underneath the bottom of the door. The other end of the strap has a bolt through it which is encircled by a loop of one end of a rope or cable. The other end of the rope is formed into a second loop that encircles the doorknob. In use the tubular bars are positioned so that one of the tubular bars abuts the outside of the door and the other abuts the outside of the adjacent door frame. The rope is then tightened to pull the strap taut so that the door cannot be opened from the outside.

U.S. Pat. No. 1,607,789 to Baker describes a portable door lock that is not designed for operation on doors that cooperate in closing with a doorjamb. This lock comprises a U-shaped frame having a plurality of leaves therein. The leaves are pivotally connected to each other and to the frame by a pivot pin. The pivot pin extends through slots in the side walls of the frame thereby permitting the frame to be adjusted relative to the leaves. The forward ends of the outside leaves on each side are provided with the right-angularly bent, laterally-directed biting teeth for engaging a door and a cooperating door frame when the leaves are positioned in the space or gap therebetween. In addition, each leaf is provided with a plurality of equidistantly spaced teeth that are aligned with each other. The frame also includes a bifurcated foot that is adapted to engage between the teeth on the leaves and to abut with the door and frame when the lock is in place on the door. By providing a plurality of leaves in the frame, the lock of Baker can accommodate a variety of gap sizes between the door and its cooperating frame. However, the lock of Baker is somewhat complicated in that it includes many cooperating parts.

Another portable door lock which does not require that a door abut against a door jamb in its closed position is that of U.S. Pat. No. 4,326,394 to Stein. However, this door lock, unlike the others described herein, is designed for locking a door from the outside only. It includes a metal Z-shaped bar which is adapted for insertion between a door and a door frame. Both parallel sides of the Z-shaped bar are provided with a series of holes, and the lock assembly also includes a front and a rear sliding bar, each having a slot that is adapted for receiving the front or the rear portion of the Z-shaped bar. The Z-bar is fitted into the slot of the rear sliding bar, and a bolt is placed through a hole in the Z-bar to hold the rear bar in place so that the transverse arm of the Z-bar engages the front of the door when the door is closed with the Z-bar in the gap between the door and the frame and the rear sliding bar engaging both the frame and the door on the inside of the room to be locked. The slot of the front sliding bar is then placed over the end of the Z-bar outside the room and slid to engage the front of the door and frame. A padlock is then placed through a hole in the end of the Z-bar outside the room to hold the front sliding bar in place.

U.S. Pat. No. 5,542,723 to Scharf describes a portable privacy lock that comprises a first securing plate coupled approximately at its center to a first end of a strip of webbing. Coupled to an opposite end of the webbing is a latch. A second securing plate is also coupled to the webbing near the center of the webbing. A first end of a drawstring is coupled to the first securing plate while a second end of the drawstring snakes through a first aperture located in the webbing near the first end, a second aperture substantially in the center of the second securing plate and finally through an opening in the latch. By disengaging the latch and pulling on the drawstring, the webbing folds upon itself bringing the first and second securing plates together. A hinged door and closure surface can then be secured between the first and second securing plates.

Unfortunately, Scharf is designed with multiple elements that are required to effectively operate his device. Specifically, Scharf requires a webbing and drawstring, both coupled between the first securing plate and the latch, wherein the drawstring passes through the webbing twice.

Furthermore, when the user pulls the drawstring, he must ensure that the webbing folds properly in order to securely abut the second securing plate between the door and the closure surface. Consequently, this device can be complicated to understand and relatively difficult to manufacture due to the number of elements it comprises and the complicated configuration of the different elements with respect to each other.

It can be appreciated therefore that most of the various portable door locks that are known for use in holding hinged doors closed are designed for use with the standard door and frame arrangement, whereby the hinged door cooperates with a door frame or jamb against which the door abuts when it is in its closed position. Many of the known portable door locks also require that the door have a locking bolt that is received in a bolt keeper recess or hole in a cooperating doorjamb. Several of the known portable door locks are somewhat complicated, in that they involve a large number of cooperating components, or they require that the door, frame or jamb be modified to accommodate their use. Consequently, as can be seen from the foregoing discussion, although a number of portable devices have been developed for use in holding hinged doors in the closed position, all are subject to various limitations and disadvantages.

What is therefore needed is a portable door lock that is simple to manufacture and use, and which may be easily carried in a pocket or purse. What is further needed is a portable door lock that can be utilized to hold closed a hinged door whether or not it cooperates with a door frame or jamb against which the door abuts when it is in its closed position. What is still further needed is a portable door lock that can be utilized to hold closed a hinged door that does not have a locking bolt that is received in a bolt keeper recess or hole in a cooperating doorjamb. It is yet another object of the invention to provide a portable privacy lock that can be used to hold a door that swings on hinges from an open position to a closed position in which the edge of the door opposite its hinged side is adjacent to a closure surface with a clearance gap therebetween. What is still further needed is a portable door lock that can be used in combination with doors that are arranged in various configurations with adjacent closure surfaces.

SUMMARY OF THE INVENTION

The present invention provides for a portable door lock for holding closed a hinged door wherein a clearance gap is formed between an edge of the hinged door, opposite its hinged edge, and a closure surface, the portable door lock comprising: a) an anchor of sufficient size that it can bridge the clearance gap; b) a strap secured at one end to the anchor; and c) a locking member of sufficient size that it can bridge the clearance gap, the locking member adjustably coupled to the strap, wherein when the strap is positioned within the clearance gap such that the anchor abuts one side of the hinged door and one side of the closure surface and the locking member is adjustably coupled to the strap at a point such that the locking member abuts an opposite side of the hinged door and an opposite side of the closure surface, the hinged door is held closed.

The strap of the portable door lock is selected from the group of materials consisting of string, twine, leather, cloth, plastic, metal, and synthetic materials which adhere when pressed together sold under the trademark VELCRO. Furthermore, the anchor of the portable door lock has a shape selected from the group of shapes consisting of a flat plate, a semi-circular tube and a corrugated plate. Still further, the locking member of the portable door lock has a shape selected from the group of shapes consisting of a flat plate, a semi-circular tube and a corrugated plate.

The present invention also contemplates a portable door lock for holding closed a hinged door wherein a clearance gap is formed between an edge of the hinged door, opposite its hinged edge, and a closure surface, the portable door lock comprising: a) a flat plate of sufficient size that it can bridge the clearance gap; b) a strap of a first VELCRO material secured at one end to the anchor; c) a locking member of sufficient size that it can bridge the clearance gap; and d) a strip of a second VELCRO material coupled to the locking member for adjustably coupling the locking member to the strap, wherein when the strap is positioned within the clearance gap such that the anchor abuts one side of the hinged door and one side of the closure surface and the locking member is adjustably coupled to the strap at a point such that the locking member abuts an opposite side of the hinged door and an opposite side of the closure surface, the hinged door is held closed.

DETAILED DESCRIPTION OF THE PREFERRED EMBODIMENT

The preferred embodiment of the present invention provides for a portable door lock for use in holding closed a door that swings on hinges from an open position to a closed position wherein the edge of the door opposite its hinged edge is adjacent to a closure surface having a clearance gap therebetween. The door is thereby held from motion with respect to the adjacent closure surface. By closure surface, it is intended to include both door jambs which abut against an edge of the door and door jambs that do not abut against an edge of the door but are instead adjacent to the door thereby forming a straight gap therebetween. The closure surface can be made of any material and have any shape provided it creates a gap between itself and an edge of the door, opposite the door's hinged edge. Finally, it should be understood that the hinged door and the closure surface both have an outside surface and an inside surface. In the case wherein the portable door lock is used to hold closed a restroom stall door, the inside surfaces of the hinged door and the closure surface are within the restroom stall and the outside surfaces of the hinged door and the closure surface are outside of the restroom stall.

The present invention provides for the advantages of minimal elements and simplicity of design and operation. For example, the present invention does not require a webbing such as that described in Scharf above, for holding the different elements together. Nor does the present invention require a cord clamp, which may be a relatively expensive element to include, although the present invention can be configured to incorporate this element. Such a webbing is confusing to incorporate and utilize as it must be integrated with the cord and folded in a particular manner in order to properly align the two securing plates with respect to the door.

Figure 1:
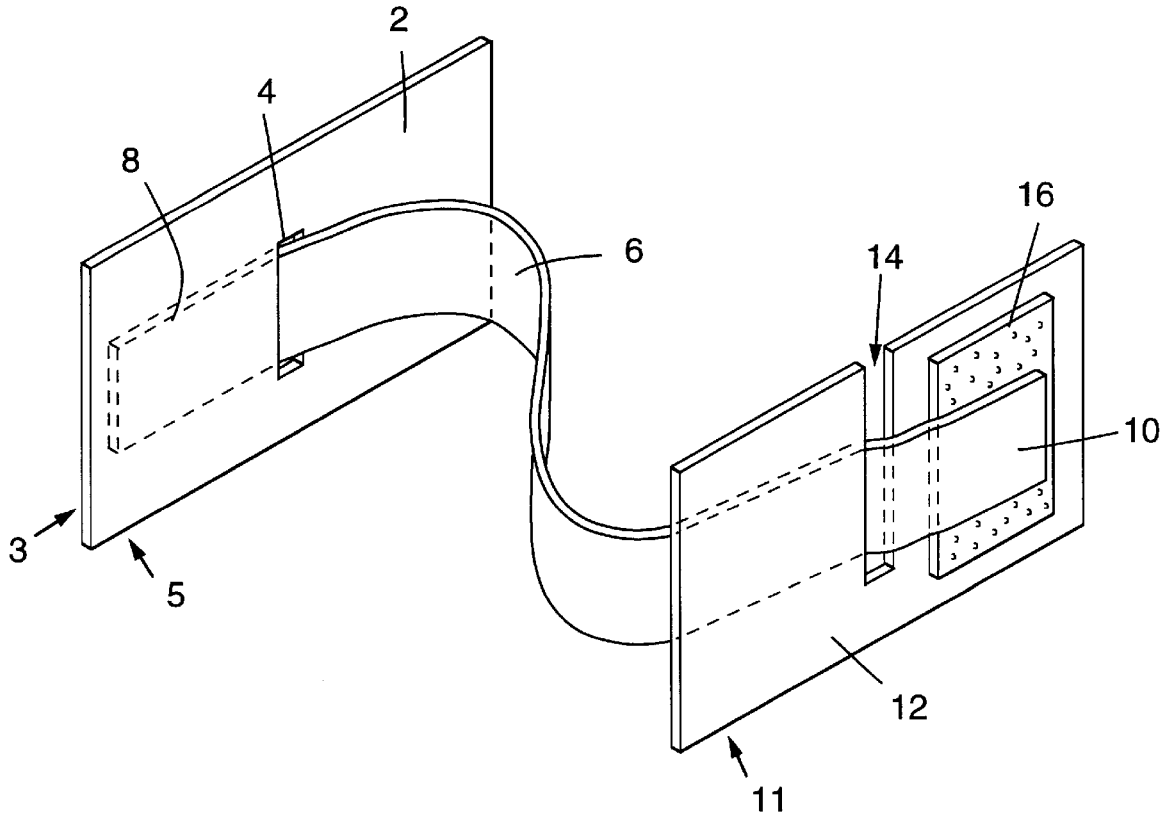
FIG. 1 illustrates a perspective view of the preferred embodiment of the present invention.

FIG. 1 illustrates a perspective view of the preferred embodiment of the present invention. The preferred embodiment comprises an anchor 2 having an aperture 4 for receiving a first end 8 of strap 6 which is secured to side 3 of the anchor 2. The preferred embodiment also comprises a locking member 12 having a slot 14 for receiving a second end 10 of the strap 6. A strip 16 is coupled to side 11 of the locking member 12 for adjustably mating with the second end 10 of the strap 6.

Figure 2:
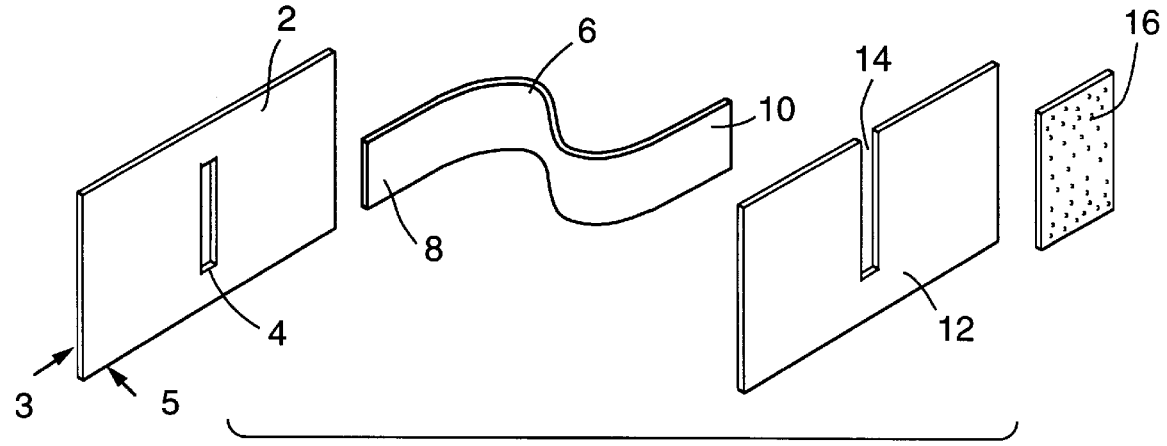
FIG. 2 illustrates an exploded perspective view of the different components of the preferred embodiment.

FIG. 2 illustrates an exploded perspective view of the preferred embodiment. The anchor 2 is preferably a flat rectangular plate having an aperture 4 located substantially in the center of the anchor 2 and comprised of a lightweight yet sturdy metal or metal composite. It is also contemplated, however, that the anchor 2 be made from any material including, but not limited to metals, composites, plastics, ceramics, cardboard or other paper products. The exact dimensions of the anchor 2 are not critical to the effective operation of the present invention, however, it must be of sufficient size that the anchor 2 can bridge the clearance gap between the edge of the restroom stall door, opposite the hinged edge, and the closure surface. It is preferable, however, that the anchor 2 not be too large that it will be inconvenient to fit in a user's pocket or purse.

It is also contemplated, that the anchor 2 can have any shape including, but not limited to, squares, circles, ovals, and triangles. In addition, the anchor 2 can have any cross sectional shape including, but not limited to, the semi-circular tube shown in FIGS. 3*a* or the corrugation shown in FIG. 3*b*. The flat plate 2 can also be designed without the aperture 4 as the strap 6 can be coupled to the flat plate 2 by any means well known in the art. For example, the strap can alternatively be glued to the side 5 of the flat plate 2.

The strap 6 is preferably a predetermined length of the male or hooking portion of a VELCRO strip (a first VELCRO material). It is also contemplated, however, that a female or looping portion of the VELCRO be alternatively used. By male and female portions, it is meant that VELCRO strips comprise a male strip and a female strip which can be held together by mating the appropriate sides together. It is also contemplated, however, that other straps well known in the art be used. This includes, but is not limited to lengths of cord, wire, string, nylon, cloth and plastic. Of course, with these additional straps, different holding means will be necessary. For example, a cloth or leather strap and buckle combination could be used. Such holding means are well known in the art.

The locking member 12 is also preferably a flat rectangular plate comprised of a light weight yet sturdy metal or metal composite and having a slot 14 for receiving the second end 10 of the strap 6. It is also contemplated that the locking member 12 be made from any material including, but not limited to, metals, composites, plastics, ceramics, cardboard or other paper products. The exact dimensions of the locking member 12 are not critical to the effective operation of the present invention, however, it must be of sufficient size that the locking member 12 can bridge the clearance gap between the edge of the door, opposite the hinged edge, and the closure surface. It is preferable, however, that the locking member 12 not be too large that it will be inconvenient to fit in a user's pocket or purse.

It is contemplated, that the locking member 12 can have any shape including, but not limited to squares, circles, ovals, and triangles. It is also contemplated that the locking member 12 not be flat but can have any cross sectional shape including, but not limited to, the semicircular tube shown in FIGS. 3*a* or the corrugation shown in FIG. 3*b*. The anchor 12 can also be designed without the slot 14. Alternatively, the locking member 12 could have an aperture or loop integrally formed with or attached to the locking member 12 (not shown) for accepting the strap 6.

As shown in FIGS. 1 and 2, the preferred embodiment also comprises a strip 16 coupled to side 11 of the locking member 12 for mating with the second end 10 of the strap 6. The strip 16 is a female portion of a VELCRO strip (a second VELCRO material) for mating with end 10 of the strap 6. It is also contemplated that the present invention include other well known means for adjustably holding the strap 6 to the locking member 12. For example, as shown in FIGS. 3*c* and 3*d*, the present invention could incorporate a cord 20 and a cord clamp 21 such as that described in U.S. Pat. No. 4,328,605, herein incorporated by reference, and which is assigned to the T-Plastech Company of Denver, Colorado. In this embodiment, cord clamp 21 acts as the locking member so it must be of sufficient size so that it will bridge the clearance gap between the hinged door and the closure surface.

Figure 3A:
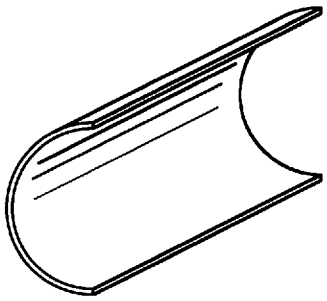
FIG. 3*a* illustrates an alternate element which may be incorporated into the preferred embodiment.
Figure 3B:
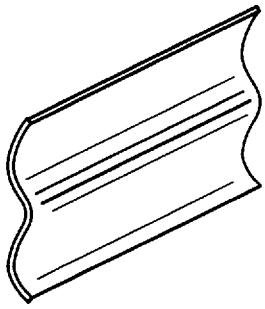
FIG. 3*b* illustrates an alternate element which may be incorporated into the preferred embodiment.
Figure 3C:
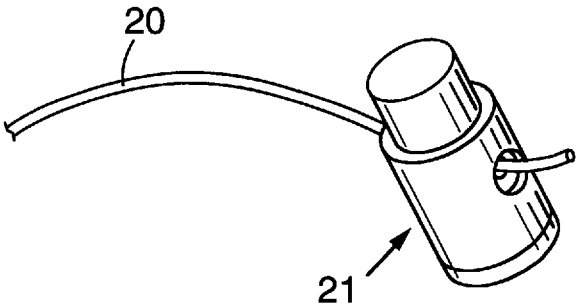
FIG. 3*c* illustrates an alternate element which may be incorporated into the preferred embodiment.
Figure 3D:
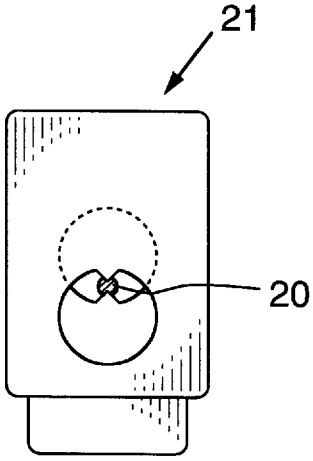
FIG. 3*d* illustrates a functional view of the alternative element of FIG. 3*c*.

The cord 20 and cord clamp 21, as shown in FIG. 3*c* and 3*d* could be used in combination with the semi-circular tube anchor illustrated in FIG. 3*a* to form another preferred embodiment of the present invention. This combination would provide for a device that minimizes the number of elements needed and the complexity of operation. Also, when the device is not in use, the user can slide the cord clamp so that it fits snugly adjacent to and within the semi-circular tube thereby creating an aesthetically pleasing form that minimizes space.

Figure 4:
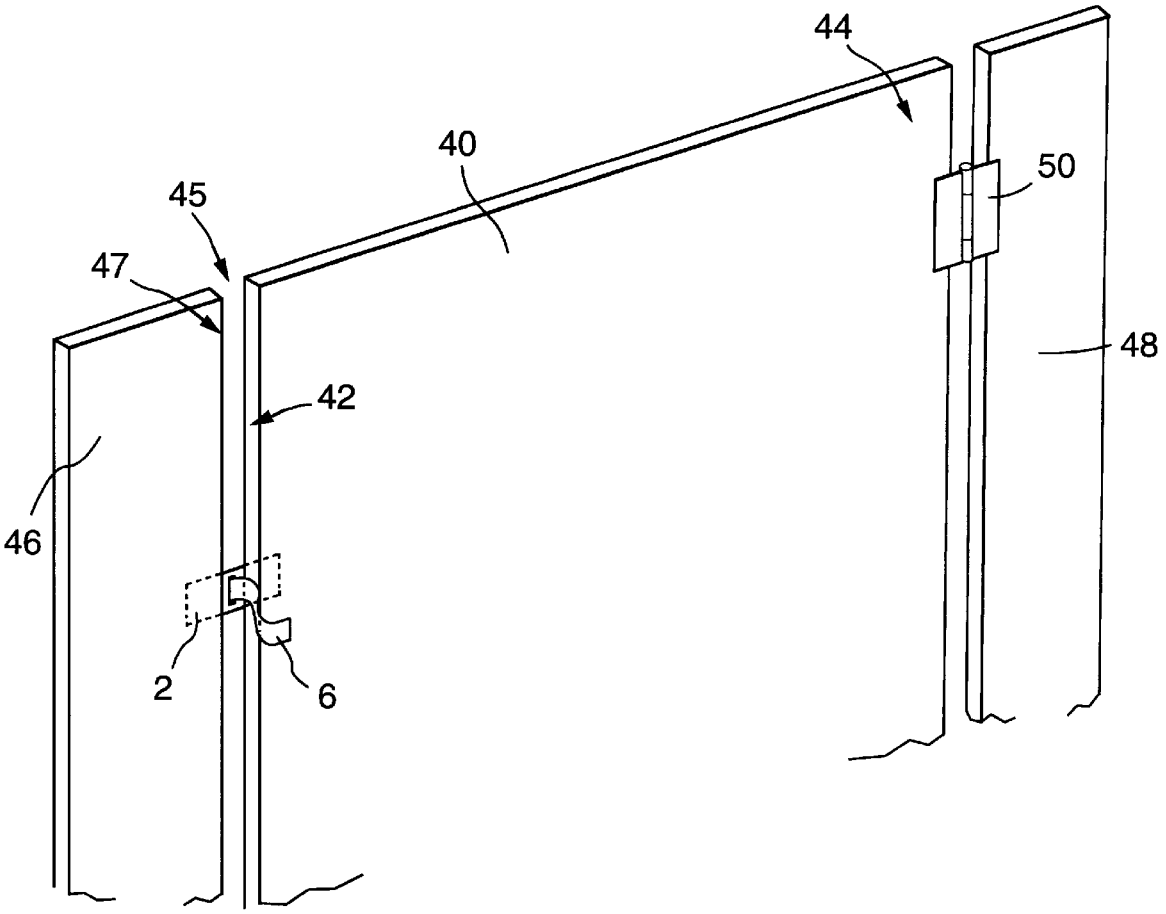
FIG. 4 illustrates a perspective view of the anchor in position within the clearance gap of a restroom stall door.
Figure 5:
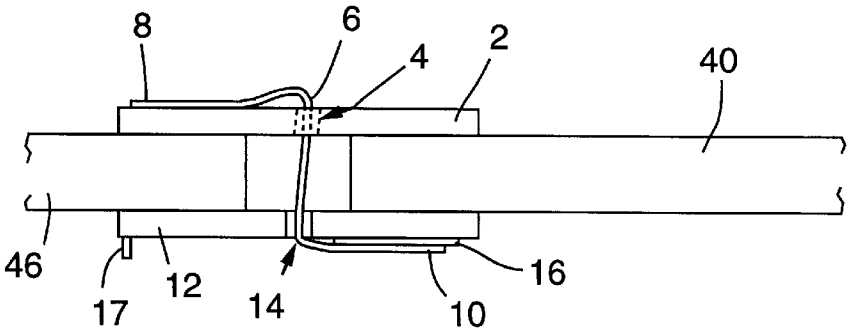
FIG. 5 illustrates a top view of the preferred embodiment of the present invention while holding closed a hinged door.
Figure 6:
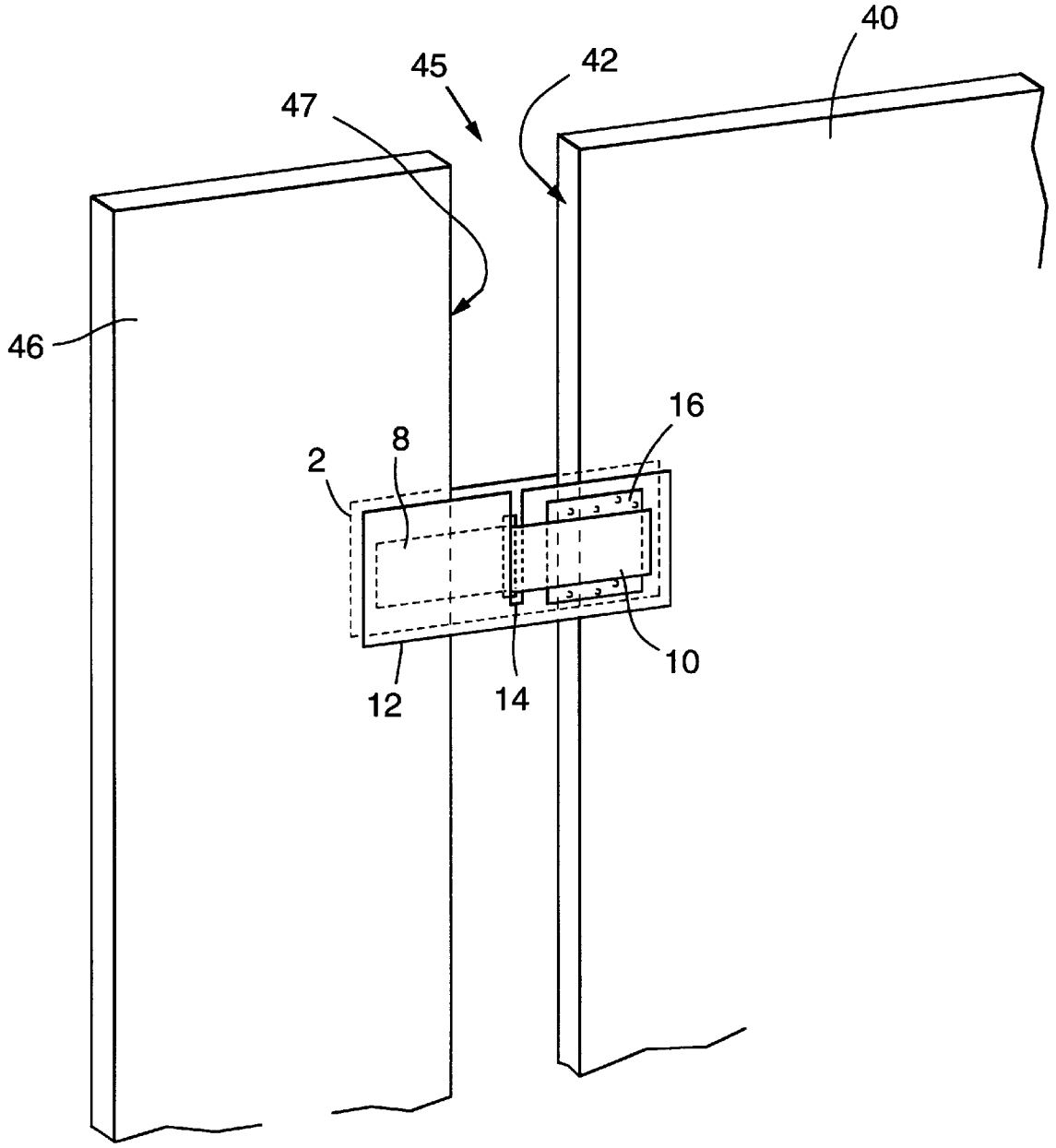
FIG. 6 illustrates a perspective view of the preferred embodiment of the present invention securing a restroom stall door in a closed position.

FIGS. 4–6 illustrate operation of the preferred embodiment of the present invention with a restroom stall door 40. Although described with reference to a restroom stall door, the present invention is not limited to restroom stall doors and will work equally well with any hinged door having an adjacent closure surface and a clearance gap therebetween. The restroom stall door 40 has a hinged door edge 44 which is coupled via a hinge 50 to frame 48. A clearance gap 45 is formed between the hinged door edge 44, opposite the hinged edge 44, and the edge 47 of the closure surface 46 closest to the hinged door 40.

In operation, a user closes the restroom stall door 40 while holding the strap 6 within the clearance gap 45 such that the anchor 2 bridges clearance gap 45 and simultaneously abuts a portion of the outside surface of the restroom stall door 40 near its edge 42 and a portion of the outside surface of the closure surface 46 near its edge 47.

While holding the strap 6 taught, the user slides the end 10 of the strap 6 through the slot 14 of the locking member 12. The user then pulls the strap 6 to ensure that the anchor 2 is abutting the outside surface of the restroom stall door edge 40 near its edge 42 and the outside surface of the closure surface 46 near its edge 47, and bridges the clearance gap 45 while abutting the locking member 12 to the inside surface of the restroom stall door 40 near its edge 42 and the inside surface of the closure surface 46 near its edge 47. As shown in FIG. 5, the locking member 12 can incorporate a handle 17 to assist the user in handling the locking member 12. One skilled in the art will be able to incorporate any one of many known handles or grasping members to the locking member 12.

After the anchor 12 and locking member 12 are abutted against the hinged door and closure surface as described above, the end 10 of the strap 6 is then mated with the strip 16 to hold the anchor 2 and locking member 12 in position. When in position, the anchor 2 and locking member 12 prevent the hinged restroom door from opening until the user releases the strap 6 from the strip 16 and separates the locking member 12 from the strap 6.

Figure 7:
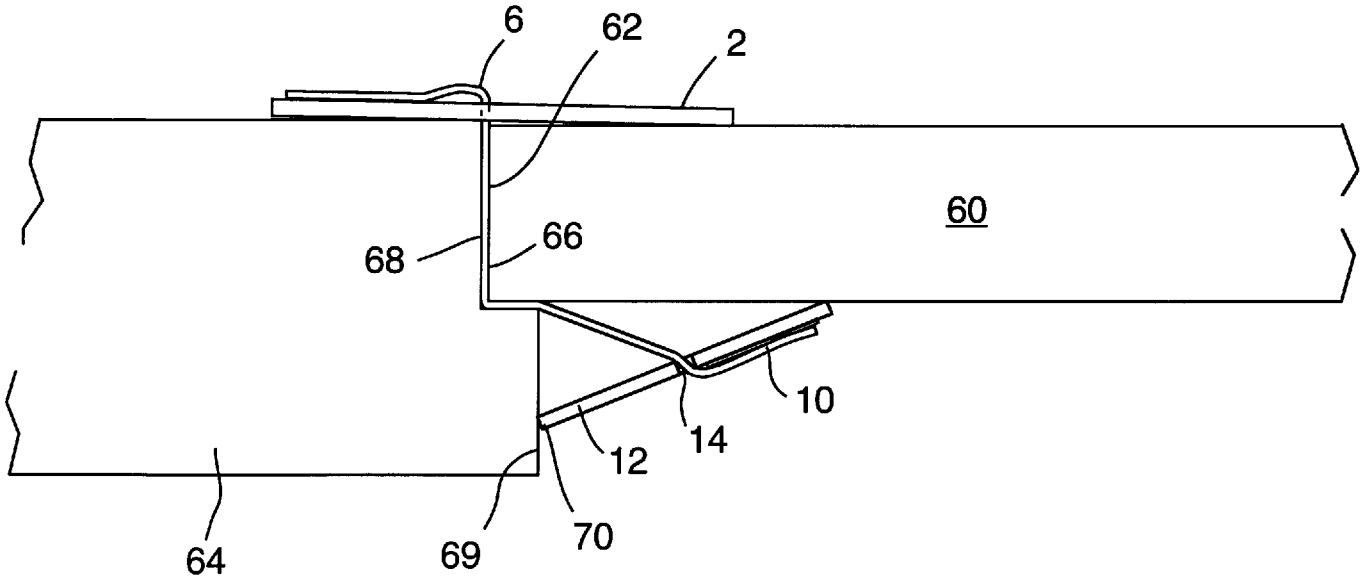
FIG. 7 illustrates a top view of the preferred embodiment of the present invention with a common (non-restroom stall) door.

As discussed above, it is also contemplated that the present invention not be limited to restroom stall doors but also be utilized with conventional doors and door jambs. FIG. 7 illustrates a top view of the preferred embodiment of the present invention utilized with a conventional hinged door 60 having an edge 62 opposite a hinged edge (not shown) and door jamb 64 having an edge 68 near the door 60. A gap 66 is formed between the edge 62 of the hinged door 60 and the edge 68 of the door jamb 64.

In operation, the strap 6 is inserted into the gap 66 such that the anchor 2 bridges the gap 66 and is abutted against the outside of the hinged door 60 and doorjamb 64 similar to the configuration shown in FIGS. 4–6. The door 60 is then closed leaving the end 10 of the strap 6 exposed on the inside of the door 60. By feeding the end 10 of the strap 6 through the slot 14 of the locking member 12, the end 10 can be mated with the locking member 12 such that the locking member 12 abuts the inside of the door 60 and doorjamb 64. The door 60 is thereby prevented from unauthorized opening due to the frictional forces between the edge 70 of the locking member 12 and the edge 69 of the doorjamb 64.

While the present invention has been described in detail by way of illustration and example for purposes of clarity of understanding, it will be understood by those skilled in the art that certain changes and modifications may be made to the above-described embodiments without departing from the spirit of the invention and scope of the appended claims.

What is claimed is:

1. A portable door lock for holding closed a hinged door wherein a clearance gap is formed between an edge of the hinged door, opposite its hinged edge, and a closure surface, the portable door lock comprising:

a) an anchor of sufficient size that it can bridge the clearance gap, wherein the anchor has a shape selected from the group of shapes consisting of a flat plate, a semi-circular tube and a corrugated plate;

b) a strap secured at one end to the anchor; and c) a locking member of sufficient size that it can bridge the clearance gap, wherein the locking member has a shape selected from the group of shapes consisting of a flat plate, a semi-circular tube and a corrugated plate, the locking member adjustably coupled to the strap such that the strap is held tightly in position by the locking member, wherein when the strap is positioned within the clearance gap such that the anchor abuts the hinged door and the closure surface and the locking member is adjustably coupled to the strap at a point such that the locking member abuts the hinged door and the closure surface opposite to the anchor, the hinged door is held closed.

2. The portable door lock of claim 1 wherein the strap is selected from the group of materials consisting of string, twine, leather, cloth, plastic, metal, and VELCRO.

3. The portable door lock of claim 1 wherein the locking member is a cord clamp.

4. A portable door lock for holding closed a hinged door wherein a clearance gap is formed between an edge of the hinged door, opposite its hinged edge, and a closure surface, the portable door lock comprising:

a) an anchor of sufficient size that it can bridge the clearance gap;

b) a strap of a first VELCRO material secured at one end to the anchor;

c) a locking member of sufficient size that it can bridge the clearance gap; and d) a strip of a second VELCRO material coupled to the locking member for adjustably coupling the locking member to the strap, wherein when the strap is positioned within the clearance gap such that the anchor abuts the hinged door and the closure surface and the locking member is adjustably coupled to the strap at a point such that the locking member abuts of the hinged door and of the closure surface opposite to the anchor, the hinged door is held closed.

5. The portable door lock of claim 4 wherein the strap is selected from the group of materials consisting of string, twine, leather, cloth, plastic, metal, and VELCRO.

6. The portable door lock of claim 4 wherein the anchor has a shaped selected from the group of shapes consisting of a flat plate, a semi-circular tube and a corrugated plate.

7. The portable door lock of claim 4 wherein the locking member has a shape selected from the group of shapes consisting of a flat plate, a semi-circular tube and a corrugated plate.

* * * * *